US008294619B2

(12) United States Patent
Lee et al.

(10) Patent No.: US 8,294,619 B2
(45) Date of Patent: Oct. 23, 2012

(54) UNSYMMETRICAL DUAL BAND ANTENNA

(75) Inventors: Chang-Jung Lee, Taoyuan County (TW); Jian-Jhih Du, Taipei (TW)

(73) Assignee: Arcadyan Technology Corporation, Hsinchu (TW)

( * ) Notice: Subject to any disclaimer, the term of this patent is extended or adjusted under 35 U.S.C. 154(b) by 303 days.

(21) Appl. No.: 12/805,771

(22) Filed: Aug. 19, 2010

(65) Prior Publication Data

US 2011/0043410 A1 Feb. 24, 2011

(30) Foreign Application Priority Data

Aug. 19, 2009 (TW) ..... 98127886 A

(51) Int. Cl.
*H01Q 1/38* (2006.01)

(52) U.S. Cl. ..... 343/700 MS; 343/897; 343/860

(58) Field of Classification Search ..... 343/700 MS, 343/702, 863, 893, 897
See application file for complete search history.

(56) References Cited

U.S. PATENT DOCUMENTS

| | | | | |
|---|---|---|---|---|
| 7,773,040 | B2 * | 8/2010 | Rao et al. | 343/729 |
| 7,911,392 | B2 * | 3/2011 | Rao et al. | 343/700 MS |
| 8,044,863 | B2 * | 10/2011 | Ali et al. | 343/700 MS |
| 2003/0103010 | A1 * | 6/2003 | Boyle | 343/702 |
| 2011/0309984 | A1 * | 12/2011 | Chiu et al. | 343/700 MS |

* cited by examiner

*Primary Examiner* — Don Le
(74) *Attorney, Agent, or Firm* — Rabin & Berdo, P.C.

(57) ABSTRACT

An unsymmetrical dual-band antenna including a substrate, a first radiation unit, a second radiation unit and an impedance matching unit is provided. The substrate has a first surface and a second surface opposite to the first surface. The first radiation unit disposed on the first surface of the substrate includes first and second radiation portions connected to each other. The second radiation unit disposed on the first surface of the substrate includes third and fourth radiation portions connected to each other. The third radiation portion is disposed on the first surface of the substrate and adjacent to the first radiation portion. The impedance matching unit disposed on the second surface includes first to fourth patches. The first and the second patch are electrically connected to a feeding point. The third and the fourth patch are electrically connected to a ground point.

12 Claims, 6 Drawing Sheets

UNSYMMETRICAL DUAL BAND ANTENNA

This application claims the benefit of Taiwan application Serial No. 98127886, filed Aug. 19, 2009, the subject matter of which is incorporated herein by reference.

TECHNICAL FIELD

The invention relates in general to a dual-band antenna, and more particularly to an unsymmetrical dual-band antenna.

BACKGROUND

Living in today's society where information volume increases rapidly, portable digital products, such as mobile phones, personal digital assistants and notebook computers, are getting more and more popular and indispensable. In addition to functions, consumers are also concerned with the outlooks and portability of the products. Therefore, how to effectively reduce the volume of the antenna to make the mobile phone compact and versatile and at the same time to maintain the features of the antenna and to increase its application has become a key technology to the new generation mobile phone.

Nowadays, the communication products are directed towards slimness, compactness and lightweight so as to increase the portability and application. Thus, how to reduce the volume of the antenna and at the same time to provide excellent radiation so as to make the communication products slim, compact and light weighted has become a common goal to achieve.

BRIEF SUMMARY

Embodiment of the invention is directed to an unsymmetrical dual-band antenna with reduced volume and the effect of omni-directional radiation.

According to one example of the present invention, an unsymmetrical dual-band antenna including a substrate, a first radiation unit, a second radiation unit and an impedance matching unit is provided. The substrate has a first surface and a second surface opposite to the first surface. The first radiation unit is disposed on the first surface of the substrate and includes a first radiation portion and a second radiation portion. The first radiation portion has a first length and is operated within a first band, and the second radiation portion has a second length and is operated within a second band, wherein the second radiation portion is connected to the first radiation portion, the second length is larger than the first length, and the frequency of the first band is larger than that of the second band. The second radiation unit, being disposed on the first surface of the substrate and adjacent to the first radiation unit, includes a third radiation portion and a fourth radiation portion. The third radiation portion, having a third length substantially identical to the second length adjacent to the first radiation portion, is operated within a third band. The fourth radiation portion, having a fourth length substantially identical to the first length adjacent to the second radiation portion, is operated within a fourth band, wherein the fourth radiation portion is connected to the third radiation portion, the first band is equal to the third band, and the second band is equal to the fourth band. The impedance matching unit is for adjusting the impedance matching of the unsymmetrical dual-band antenna and disposed on the second surface. The impedance matching unit includes a first to a fourth patch opposite to the first to the fourth radiation portion respectively. The first to the fourth patch are electrically connected to the first to the fourth radiation portion respectively. The first and the fourth patch respectively have a first slit and a second slit, wherein the first width and the second width of the first slit and the second slit respectively are related to the impedance of the unsymmetrical dual-band antenna. The first and the second patch are electrically connected to a feeding point respectively, and the third and the fourth patch are electrically connected to a ground point respectively.

It is to be understood that both the foregoing general description and the following detailed description are exemplary and explanatory only and are not restrictive of the disclosed embodiments, as claimed.

DETAILED DESCRIPTION OF EXEMPLARY EMBODIMENT OF THE INVENTION

Figure 1:
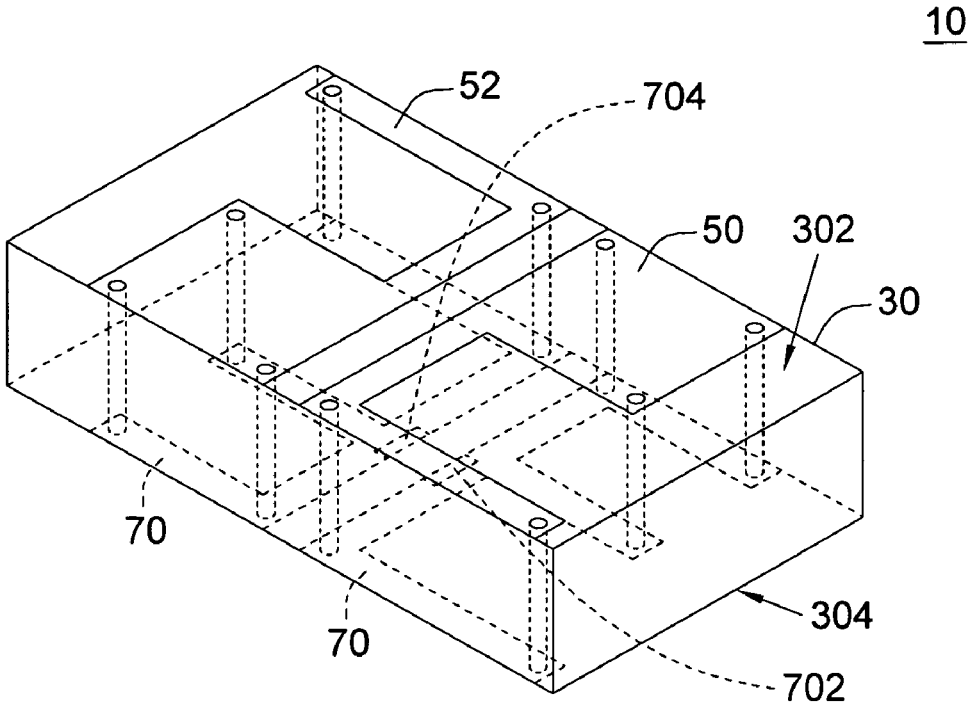
FIG. 1 shows an unsymmetrical dual-band antenna according to an embodiment of the invention.

Referring to FIG. 1, an unsymmetrical dual-band antenna according to an embodiment of the invention is shown. The unsymmetrical dual-band antenna 10 includes a substrate 30, a first radiation unit 50, a second radiation unit 52 and an impedance matching unit 70. The substrate 30 has a first surface 302 and a second surface 304 opposite to the first surface 302. The first radiation unit 50 and the second radiation unit 52 both are disposed on the first surface 302 of the substrate 30. The impedance matching unit 70 is disposed on the second surface 304 of the substrate 30 and opposite to the first radiation unit 50 and the second radiation unit 52.

Figure 2A:
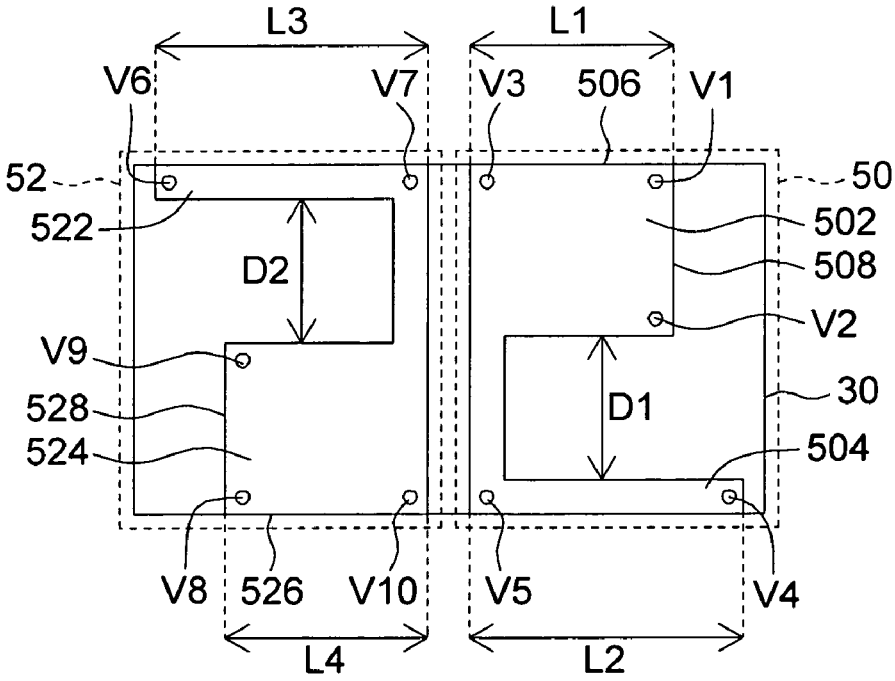
FIG. 2A shows a structural diagram of a first radiation unit and a second radiation unit of the unsymmetrical dual-band antenna of FIG. 1.

Referring to FIG. 2A, a structural diagram of the first radiation unit 50 and the second radiation unit 52 of the unsymmetrical dual-band antenna of FIG. 1 is shown. The first radiation unit 50 includes a first radiation portion 502 and a second radiation portion 504. The first radiation portion 502 has a first length L1 and is connected to the second radiation portion 504. The first radiation portion 502 is operated within a first band. The second radiation portion 504 has a second length L2 and is operated within a second band. The second radiation unit 52 includes a third radiation portion 522 and a fourth radiation portion 524. The third radiation portion 522 has a third length L3 and is operated within the first band. The third length L3 is substantially equal to the second length L2. The fourth radiation portion 524 has a fourth length L4 and is connected to the third radiation portion 522. The fourth radiation portion 524 is operated within the second band. The fourth length L4 is substantially equal to the first length L1. The first radiation portion 502 is adjacent to the third radiation portion 522 and the second radiation portion 504 is adjacent to the fourth radiation portion 524. The frequency of the first band is larger than that of the second band.

Figure 2B:
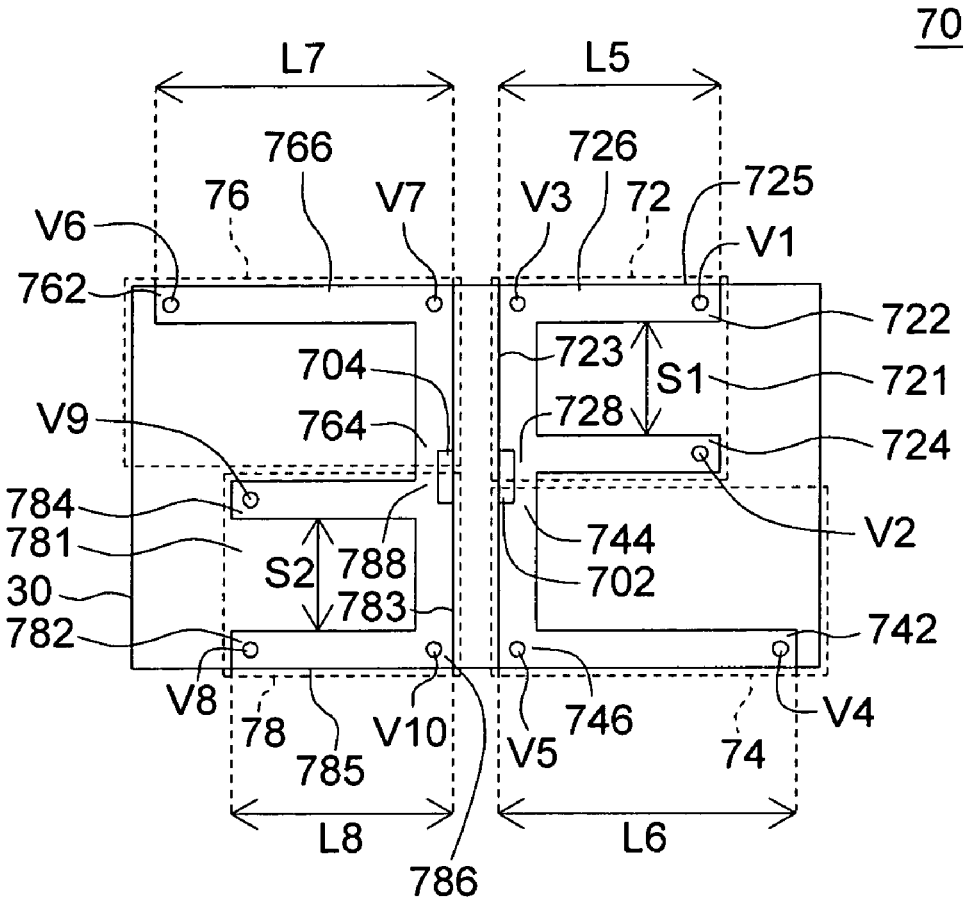
FIG. 2B shows a structural diagram of an impedance matching unit of the unsymmetrical dual-band antenna of FIG. 1.

Referring to FIG. 2B, a structural diagram of the impedance matching unit of the unsymmetrical dual-band antenna of FIG. 1 is shown. The impedance matching unit 70 adjusts the impedance match of the unsymmetrical dual-band antenna 10 of the present embodiment of the invention. The impedance matching unit 70 includes a first patch 72, a second patch 74, a third patch 76 and a fourth patch 78.

The first patch 72, the second patch 74, the third patch 76 and the fourth patch 78 are opposite to and electrically connected to the first radiation portion 502, the second radiation portion 504, the third radiation portion 522 and the fourth radiation portion 524, respectively. The first patch 72 and the fourth patch 78 have a first slit 721 and a second slit 781, respectively. The first patch 72 is connected to the second patch 74 and electrically connected to a feeding point 702. The third patch 76 is connected to the fourth patch 78 and electrically connected to a ground point 704.

Furthermore, the substrate 30 further has many via holes through which the first patch 72, the second patch 74, the third patch 76 and the fourth patch 78 are electrically connected to the first radiation portion 502, the second radiation portion 504, the third radiation portion 522 and the fourth radiation portion 524, respectively. In the present embodiment of the invention, the substrate 30 has ten via holes, but the invention is not limited thereto. The ten via holes are the first to the tenth via hole V1~V10.

The first length L1 of the first radiation portion 502 and the second length L2 of the second radiation portion 504 both affect the radiation frequency of the unsymmetrical dual-band antenna 10. Through suitable design of the first length L1 and the second length L2, the antenna is able to transmit/receive the signals in frequencies of the wireless communication device. In the present embodiment of the invention, the first radiation portion 502 such as corresponds to a high-frequency signal whose frequency ranges from 4.9 GHz to 5.875 GHz, wherein the frequency range of 4.9 GHz to 5.875 GHz is the first band. The second radiation portion 504 such as corresponds to a low-frequency signal whose frequency ranges from 2.4 GHz to 2.5 GHz, wherein the frequency range of 2.4 GHz to 2.5 GHz is the second band. By making the first length L1 and the second length L2 different from each other, the unsymmetrical dual-band antenna 10 of the present embodiment of the invention is operated in dual bands. The unsymmetrical dual-band antenna 10 is adapted to the wireless networking standards 802.11a/b/g/n of the Institute of Electrical and Electronic Engineer (IEEE) or the wireless LAN (WLAN) protocol. In the present embodiment of the invention, the first patch 72 is substantially a U-shaped structure connected to the second patch 74. The first patch 72 further has a first end 722, a second end 724, a first turning end 726, a second turning end 728, a first short side 723 and a first long side 725. The first patch 72 has a fifth length L5. As indicated in FIG. 2A, through the first to the third via hole V1~V3 of the substrate 30, the first radiation portion 502 is electrically connected to the first end 722, the second end 724 and the first turning end 726 of the first patch 72 as indicated in FIG. 2B. The first slit 721 is extended along the first long side 725 of the first patch 72. The first slit 721 has a first width S1 along the first short side 723, wherein the second width S1 is associated with the impedance of the unsymmetrical dual-band antenna 10. The impedance of the unsymmetrical dual-band antenna 10 can be adjusted by changing the first width S1. Also, the lengths of the first long side 725 and the first short side 723 respectively are equal to the lengths of a long side 506 and a short side 508 of the first radiation portion 502.

The second patch is substantially an L-shaped structure corresponding to the second radiation portion 504. The second patch 74 has a third end 742, a fourth end 744 and a third turning end 746. The second patch 74 has a sixth length L6. The fourth end 744 is connected to the second turning end 728 of the first patch 72. Also, the feeding point 702, being electrically connected to the first patch 72 and the second patch 74, preferably is located at the junction of the first patch 72 and the second patch 74. As indicated in FIG. 2A, through the fourth via hole V4 and the fifth via hole V5 of the substrate 30, the second radiation portion 504 is electrically connected to the third end 742 and the third turning end 746 of the second patch 74 as indicated in FIG. 2B. The second patch 74 and the second radiation portion 504 substantially have the same size and the same shape.

The third patch 76 is substantially an L-shaped structure corresponding to the third radiation portion 522. The third patch 76 has a fifth end 762, a sixth end 764 and a fourth turning end 766. The third patch 76 has a seventh length L7. As indicated in FIG. 2A, through the sixth via hole V6 and the seventh via hole V7 of the substrate 30, the third radiation portion 522 is electrically connected to the fifth end 762 and the fourth turning end 766 of the third patch 76 as indicated in FIG. 2B. Preferably, the third patch 76 and the third radiation portion 522 substantially have the same size and the same shape.

The fourth patch 78 is substantially a U-shaped structure adjacent to the second patch 74. The fourth patch 78 further has a seventh end 782, an eighth end 784, a fifth turning end 786, a sixth turning end 788, a second short side 783 and a second long side 785. The fourth patch 78 has an eighth length L8. The sixth turning end 788 is connected to the sixth end 764 of the third patch 76. Also, the ground point 702, being electrically connected to the third patch 76 and the fourth patch 74, is preferably located at the junction of the first patch 72 and the second patch 74.

As indicated in FIG. 2A, the fourth radiation portion 524 is electrically connected to the seventh end 782, the eighth end 784 and the fifth turning end 786 of the fourth patch 78 as indicated in FIG. 2B through the eighth to the ten via holes V8~V10 of the substrate 30. The second slit 781 is extended along the second long side 785, and the second slit 781 has a second width S2 along the second short side 783. The second width S2 is associated with the impedance of the unsymmetrical dual-band antenna 10. The impedance of the unsymmetrical dual-band antenna 10 can be adjusted by changing the second width S2. The lengths of the second short side 783 and the second long side 785 respectively are equal to the lengths of a long side 526 and a short side 528 of the fourth radiation portion 524.

The shapes of the first to the fourth patch disclosed above are not limited thereto, and in other embodiments of the invention, the first slit and the second slit can have other shapes.

On the part of the unsymmetrical dual-band antenna 10 of the present embodiment of the invention, the first radiation portion 502 is adjacent to the third radiation portion 522 and the second radiation portion 504 is adjacent to the fourth radiation portion 524. The design of the unsymmetrical structure and the disposition of the impedance matching unit 70 not only make the distance D1 between the first radiation portion 502 and the second radiation portion 504 and the distance D2 between the third radiation portion 522 and the fourth radiation portion 524 smaller than the convention but further reduce the volume of the unsymmetrical dual-band antenna 10 of the present embodiment of the invention.

In the unsymmetrical dual-band antenna 10 of the present embodiment of the invention, each length preferably satisfies the following conditions:

$$L1=L3=L6=L7=0.2\sim0.3\lambda; \text{ and}$$

$$L2=L4=L5=L8=0.2\sim0.3\lambda.$$

Wherein λ is the wavelength of a signal.

Figure 3:
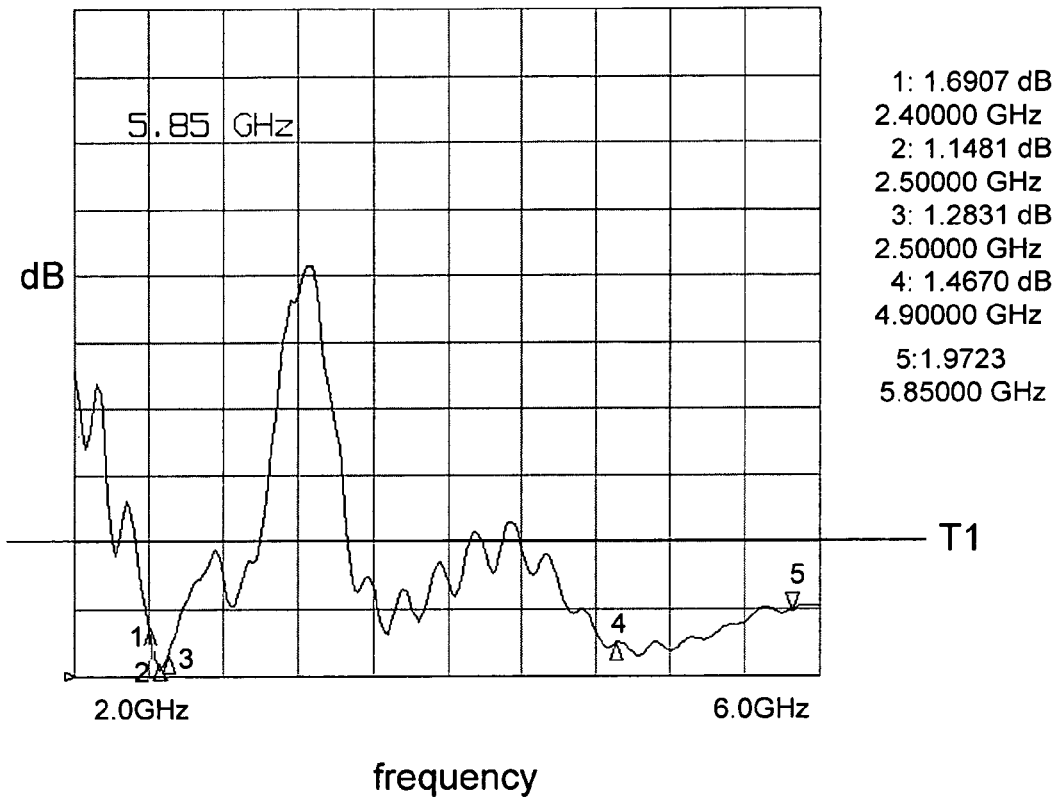
FIG. 3 shows a standing wave ratio diagram of the unsymmetrical dual-band antenna of FIG. 1.

Referring to FIG. 3, a standing wave ratio (SWR) diagram of the unsymmetrical dual-band antenna of FIG. 1 is show. Based on the band reference line T1 in which the SWR is equal to 3, the band between 2.4 GHz~2.5 GHz and the band between 4.9 GHz~5.85 GHz are obtained respectively. Furthermore, the frequencies denoted by the measurement points 1~5 are 2.4 GHz, 2.45 GHz, 2.5 GHz, 4.9 GHz and 5.85 GHz, and the corresponding SWRs are 1.6907, 1.1481, 1.2831, 1.4670 and 1.9723, respectively. Thus, the unsymmetrical dual-band antenna 10 of the present embodiment of the invention is indeed operated within dual bands, and has sufficient bandwidth.

Figure 4A:
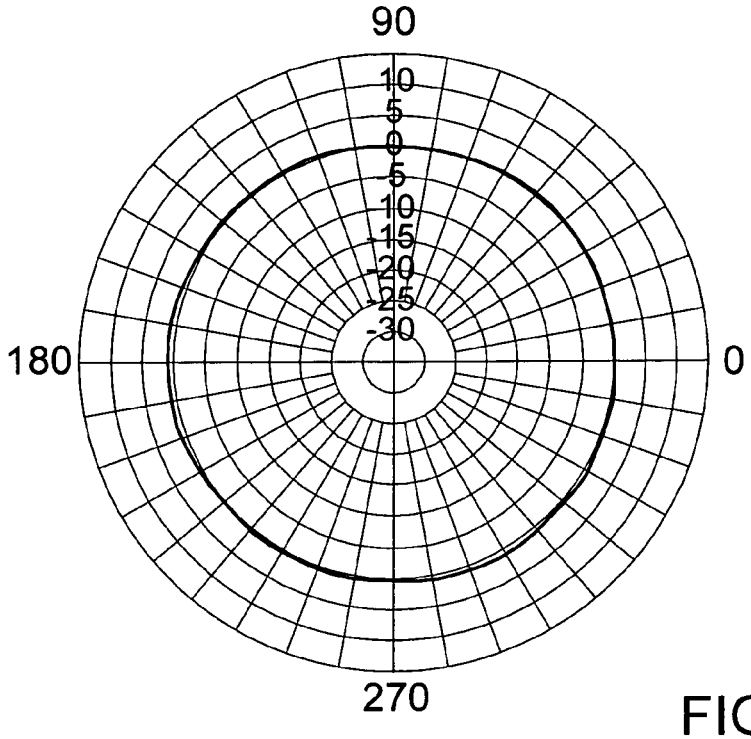
FIGS. 4A~4C show vertically polarized field patterns of the gain of the unsymmetrical dual-band antenna of FIG. 1.
Figure 4B:
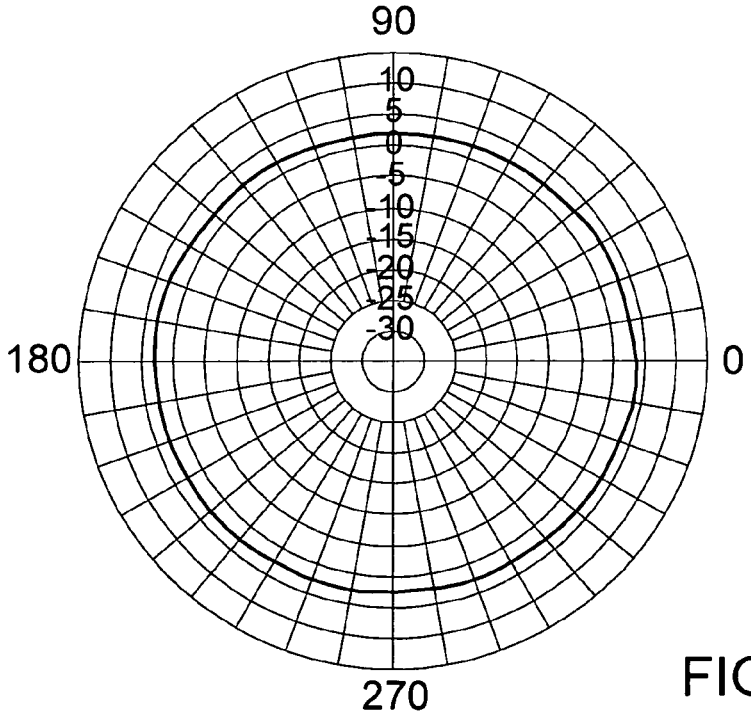
Figure 4C:
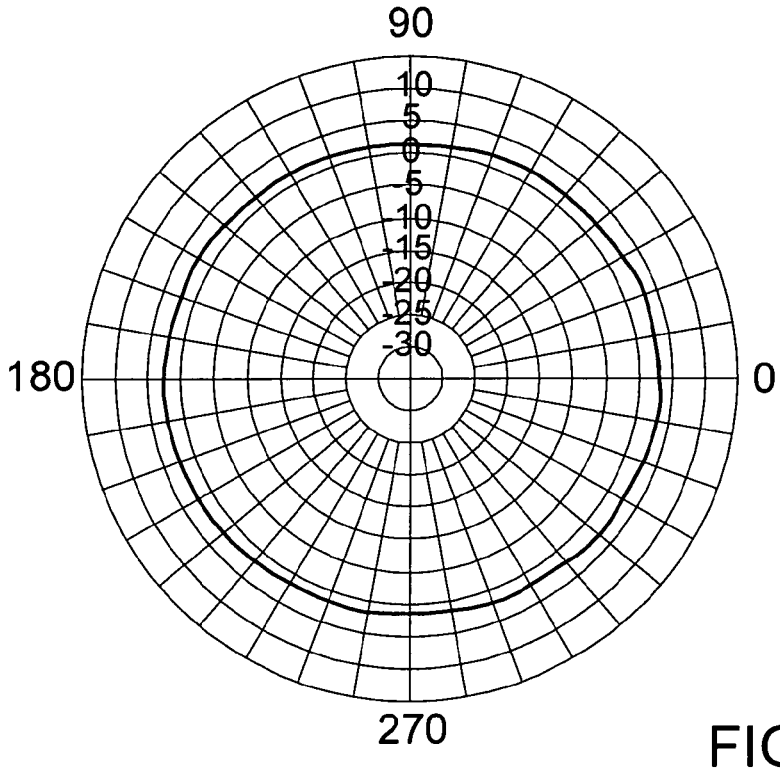

Referring to FIG. 4A~4C, vertically polarized field patterns of the gain of the unsymmetrical dual-band antenna of FIG. 1 are shown. FIGS. 4A~4C show the vertically polarized field patterns of the unsymmetrical dual-band antenna 10 operated in the frequency of 2.45 GHz, 5.25 GHz and 5.75 GHz respectively. As indicated in FIGS. 4A~4C, the unsymmetrical dual-band antenna 10 is exactly an omni-directional antenna in terms of vertical polarization. The maximum gain and average gain in vertical polarization are summarized in Table 1 below.

TABLE 1

| Frequency | 2.45 GHz | 5.25 GHz | 5.75 GHz |
|---|---|---|---|
| Maximum Gain (dBi) | 0.63 | 3.39 | 2.96 |
| Average Gain (dBi) | 0.15 | 2.26 | 1.84 |

Figure 5A:
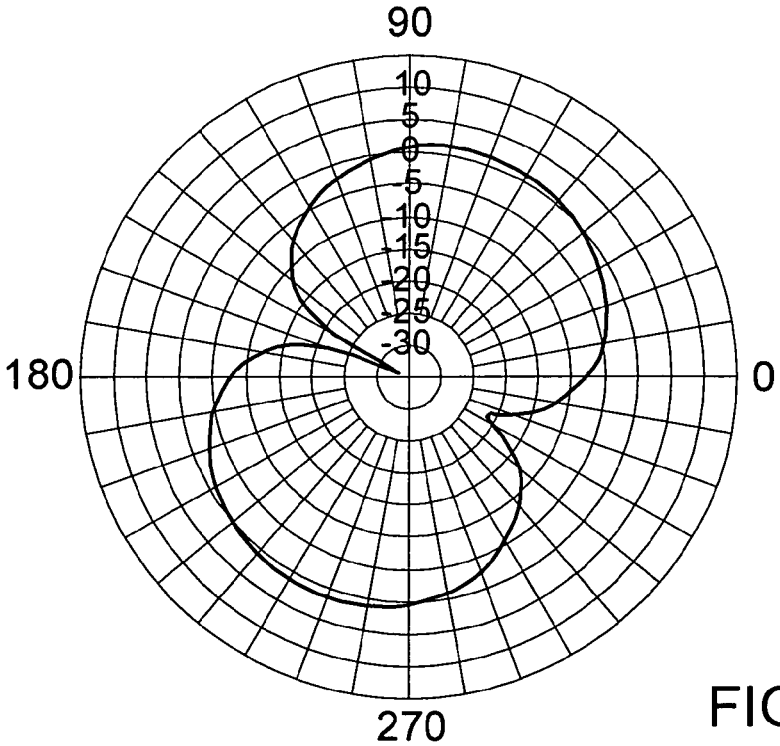
FIGS. 5A~5C show horizontally polarized field patterns of the gain of the unsymmetrical dual-band antenna of FIG. 1.
Figure 5B:
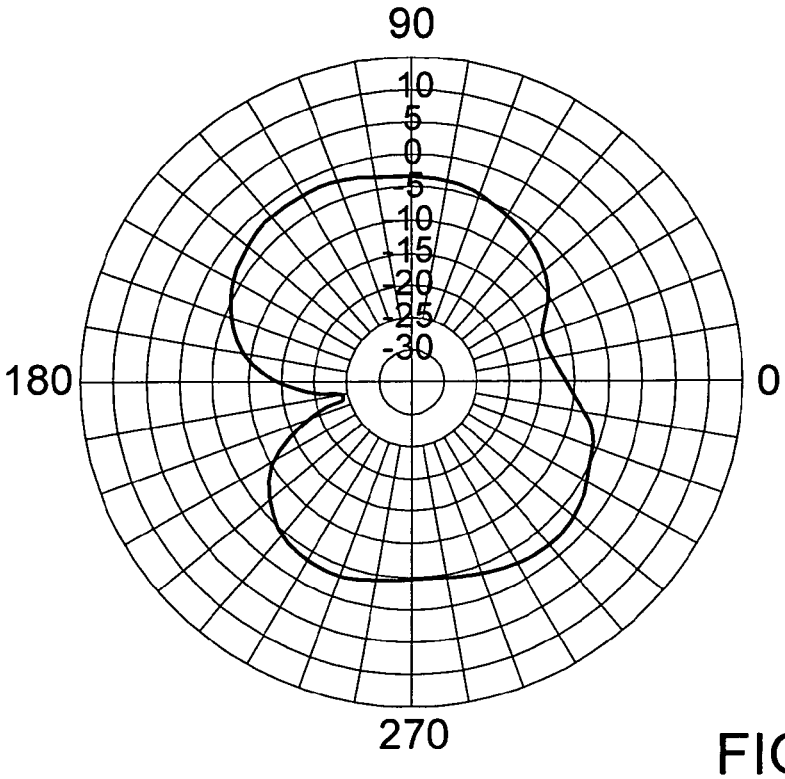
Figure 5C:
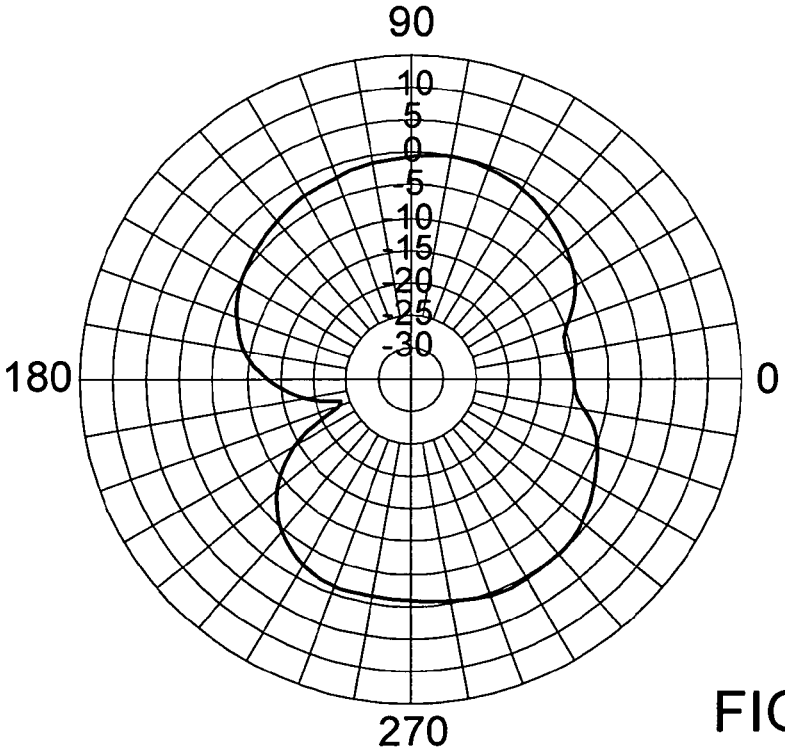

Referring to FIGS. 5A~5C, horizontally polarized field patterns of the gain of the unsymmetrical dual-band antenna of FIG. 1 are shown. FIGS. 5A~5C are horizontally polarized field patterns of the unsymmetrical dual-band antenna operated in the frequency of 2.45 GHz, 5.25 GHz and 5.75 GHz respectively. As indicated in FIG. 5A, the unsymmetrical dual-band antenna 10 has maximum gain at 246°. As indicated in FIG. 5B, the unsymmetrical dual-band antenna 10 has a maximum gain at 129°. As indicated in FIG. 5C, the unsymmetrical dual-band antenna 10 has a maximum gain at 297°. The maximum gain and average gain in horizontally polarization are summarized in Table 2 below.

TABLE 2

| Frequency (Hz) | 2.45 GHz | 5.25 GHz | 5.75 GHz |
|---|---|---|---|
| Maximum Gain (dBi) | 1.24 | −2.06 | 0.27 |
| Average Gain (dBi) | −2.27 | −5.2 | −3.22 |

As indicated in the above field patterns, the unsymmetrical dual-band antenna of the embodiment of the invention is operated in dual bands, and possesses the feature of an omni-directional antenna. Also, due to the unsymmetrical design between the first and the second radiation unit and the design of disposing the impedance matching unit on the other surface of the substrate for electrically connecting the impedance matching unit to the first and the second radiation unit, the unsymmetrical dual-band antenna can be further miniaturized, so as to increase its market value and applicability.

It will be appreciated by those skilled in the art that changes could be made to the disclosed embodiments described above without departing from the broad inventive concept thereof. It is understood, therefore, that the disclosed embodiments are not limited to the particular examples disclosed, but is intended to cover modifications within the spirit and scope of the disclosed embodiments as defined by the claims that follow.

What is claimed is:

1. An unsymmetrical dual-band antenna, comprising:

a substrate having a first surface and a second surface opposite to the first surface;

a first radiation unit disposed on the first surface of the substrate, wherein the first radiation unit comprises:

a first radiation portion having a first length, wherein the first radiation portion is operated within a first band; and a second radiation portion having a second length, wherein the second radiation portion is operated within a second band, the second radiation portion is connected to the first radiation portion, the second length is larger than the first length, and the frequency of the first band is larger than that of the second band;

a second radiation unit disposed on the first surface of the substrate and adjacent to the first radiation unit, wherein the second radiation unit comprises:

a third radiation portion having a third length substantially identical to the second length, wherein the third radiation portion is operated within the first band and adjacent to the first radiation portion; and a fourth radiation portion having a fourth length substantially identical to the first length, wherein the fourth radiation portion is operated within the second band and adjacent to the second radiation portion, and the fourth radiation portion is connected to the third radiation portion; and an impedance matching unit for adjusting the impedance match of the unsymmetrical dual-band antenna, wherein the impedance matching unit is disposed on the second surface and comprises a first patch, a second patch, a third patch and a fourth patch, opposite to and electrically connected to the first radiation portion, the second radiation portion, the third radiation portion and the fourth radiation portion respectively, the first patch and the fourth patch have a first slit and a second slit respectively, the first patch and the second patch are electrically connected to a feeding point, and the third patch and the fourth patch are electrically connected to a ground point.

2. The unsymmetrical dual-band antenna according to claim 1, wherein the first patch has a first long side and a first short side, the first slit is extended along the first long side and has a first width along the first short side, and the first width is associated with the impedance of the unsymmetrical dual-band antenna.

3. The unsymmetrical dual-band antenna according to claim 2, wherein the lengths of a long side and a short side of the first radiation portion are respectively equal to the lengths of the first long side and the first short side of the first patch.

4. The unsymmetrical dual-band antenna according to claim 1, wherein the fourth patch has a second long side and a second short side, the second slit is extended along the second long side and has a second width along the second short side, and the second width is associated with the impedance of the unsymmetrical dual-band antenna.

5. The unsymmetrical dual-band antenna according to claim 4, wherein the lengths of a long side and a short side of the fourth radiation portion are respectively equal to the lengths of the second long side and the second short side of the fourth patch.

6. The unsymmetrical dual-band antenna according to claim 1, wherein the substrate has a plurality of via holes, the first patch, the second patch, the third patch and the fourth patch are electrically connected to the first radiation portion, the second radiation portion, the third radiation portion and the fourth radiation portion respectively through at least one via hole.

7. The unsymmetrical dual-band antenna according to claim 1, wherein the first patch is substantially a U-shaped structure and has a first end, a second end, a first turning end and a second turning end; the second patch is substantially L-shaped structure and has a third end, a fourth end and a third turning end; the fourth end is connected to the second turning end of the first patch; the substrate has a first to a fifth via hole, the first radiation portion is electrically connected to the first end, the second end and the first turning end of the first patch through the first to the third via hole; and the second radiation portion is electrically connected to the third end and the second turning end of the second patch through the fourth and the fifth via hole.

8. The unsymmetrical dual-band antenna according to claim 1, wherein the third patch is substantially an L-shaped structure and has a fifth end, a sixth end and a fourth turning end; the fourth patch is substantially a U-shaped structure having U-shaped structure and has a seventh, an eighth end, a fifth turning end and a sixth turning end; the sixth turning end of the fourth patch is connected to the sixth end of the third patch; the substrate has a sixth to a tenth via hole, the third radiation portion is electrically connected to the sixth end and the fourth turning end of the first patch through the sixth and the seventh via hole; and the fourth radiation portion is electrically connected to the seventh end, the eighth end and the fifth turning end of the second patch through the eighth to the tenth via hole.

9. The unsymmetrical dual-band antenna according to claim 1, wherein the first radiation portion and the fourth radiation portion are substantially rectangular, and the second radiation portion and the third radiation portion are substantially L-shaped.

10. The unsymmetrical dual-band antenna according to claim 1, wherein the feeding point is electrically connected to the junction of the first patch and the second patch.

11. The unsymmetrical dual-band antenna according to claim 1, wherein the ground point is electrically connected to the junction of the third patch and the fourth patch.

12. The unsymmetrical dual-band antenna according to claim 1, wherein the shapes and sizes of the second patch and the third patch are respectively identical to that of the second radiation portion and the third radiation portion.

* * * * *